US005809150A

United States Patent [19]

Eberbach

[11] Patent Number: 5,809,150

[45] Date of Patent: Sep. 15, 1998

[54] SURROUND SOUND LOUDSPEAKER SYSTEM

[76] Inventor: Steven J. Eberbach, 4455 E. Loch Alpine Dr., Ann Arbor, Mich. 48103

[21] Appl. No.: 542,451

[22] Filed: Oct. 12, 1995

Related U.S. Application Data

[60] Provisional application No. 60/000,534 Jun. 28, 1995.

[51] Int. Cl.[6] ..... H04R 5/02

[52] U.S. Cl. ..... 381/24; 381/155; 381/90; 381/18; 181/145; 181/144

[58] Field of Search ..... 381/155, 24, 1, 381/17, 18, 182, 90; 181/144, 145

[56] References Cited

U.S. PATENT DOCUMENTS

| | | | |
|---|---|---|---|
| 3,739,096 | 6/1973 | Iding | 381/155 |
| 4,691,362 | 9/1987 | Eberbach | 381/99 |
| 5,400,408 | 3/1995 | Lundgren et al. | 381/159 |

*Primary Examiner*—Forester W. Isen
*Attorney, Agent, or Firm*—James M. Deimen

[57] ABSTRACT

The generation of skewed hypercardioid sound energy fields (in polar diagrams) from right front and left front "surround" loudspeakers with the principal nulls directed at the expected listener location produces the effect of sidewall and rearwall loudspeakers in a home theater setting without any actual sidewall or rearwall loudspeakers. The effect is enhanced by secondary nulls that are directed so as to "reflect" off the front wall of the room toward the expected listener location. Each surround loudspeaker contains an antiphase driver and circuitry including a delay network that powers the drivers to create the skewed hypercardioid sound energy field. The invention is independent of electrical mixing and interaction of two or more input channels. Rather the channels are assumed to be independent and the invention concerns the unique directional sound energy radiation pattern generated from each channel considered independently. An important feature of the skewed hypercardioid sound energy field according to the invention is the insensitivity of the principal null direction to frequency over a range of 120 $H_z$ to 4 $kH_z$.

Also important is a surround sound effect more pronounced in miniature (close range) speaker configurations because the energy gradient between the right and left ears is steeper with the skewed hypercardioid at close range. The invention provides a generalized method of handling direct and reflected sound in an enclosed listening space, since the parameters are variable with delay in the circuitry, the angular relationship of the drivers in the loudspeaker cabinet and the shape of the cabinet. In some listening configurations only the surround loudspeakers are necessary for superior sound reproduction.

37 Claims, 12 Drawing Sheets

AMPLITUDE VS FREQUENCY
SURROUND CHANNEL

SURROUND SOUND LOUDSPEAKER SYSTEM

BACKGROUND OF THE INVENTION

This application is based on provisional application Ser. No. 60/000,534, filed Jun. 28, 1995.

The field of the invention pertains to audio loudspeakers used in plural to realistically recreate the direct and ambient sound of an audio only, or an audio visual work such as a movie or television program and, in particular, in a home theater setting to provide sound from all directions to the viewer-listener. This invention also pertains to audio loudspeakers used for reproducing in a more realistic manner audio recordings in general ("auralization").

Stereophonic sound systems utilizing two loudspeakers, both being forward of the listener, are common. More recently bass units (subwoofers) have been added as a third separate loudspeaker. The main purpose of adding this third speaker is to allow smaller left and right speakers, thus increasing the overall convenience of the sound installation. In home theater settings the two loudspeakers have been to either side of a movie or television screen with the bass unit placed in any convenient location. Since the bass unit location has not been generally considered critical, the bass unit has frequently been hidden behind or under any convenient piece of furniture. Such stereophonic systems have been very successful.

Four channel or quadraphonic sound systems comprising full-range right and left front stereo loudspeakers and full-range right and left rear loudspeakers were developed, however, the quadraphonic sound system was a marketing failure, particularly in the private home market. One of the reasons for the marketing failure is reputed to be the difficulty in placing four large separate loudspeakers in the proper locations about the listener for best acoustic reproduction which typically conflicts with other decorating and furniture placement considerations. Another reason often cited is the additional cost of the two full-range rear loudspeakers.

Recently, package systems have been introduced that comprise five physically small loudspeakers plus a larger subwoofer. The five small loudspeakers interfere less with room decor and the subwoofer location is flexible because of its frequency range. Long wires must be installed for the two rear loudspeakers and this factor has caused some customer resistance.

The Dolby® AC3™ system is now being marketed with five full-range loudspeakers or five small loudspeakers plus a subwoofer, however, customer acceptance has not yet been proven.

Applicant's previous U.S. Pat. No. 4,578,809 and U.S. Pat. No. 4,691,362 disclose dihedral loudspeakers with variable dispersion circuits. These circuits include delay lines that drive both high frequency drivers simultaneously within a loudspeaker plus circuit elements that differentiate the energy supplied to the drivers facing away from the expected listener location from the energy supplied to the drivers facing the listener location. This patent is incorporated by reference herewith.

Also, in the past, loudspeakers have been disclosed wherein a polar plot of the sound energy comprises a cardioid, the null in energy being on the axis of symmetry through the major lobe. Such a polar plot arises from loudspeakers as disclosed in Olson, Harry F., "Gradient Loudspeakers", *Journal of the Audio Engineering Society,* Vol. 21, No. 2, March 1973, pp. 86–93.

Taking the polar plot a step further to a hypercardioid (which can be accomplished by varying the driving signal delay between the physically spaced speaker elements), the plot comprises a major lobe and a minor lobe, both lobes being symmetric about the same axis with symmetric nulls to each side of the axis. Where the major lobe and minor lobe are the same size (dipole) the nulls face directly opposite each other and are symmetric about a cross axis in turn perpendicular to the axis of symmetry of the lobes as shown by Olson (see also U.S. Pat. No. 4,961,226). Unequal lobes cause the nulls to face in equiangular directions relative to the axis of symmetry. Such polar plots arise from loudspeakers also disclosed by Olson. "Dipole" loudspeakers are described by Olson as gradient loudspeakers with zero electrical delay between the driver elements.

"Dipole" loudspeakers have been placed next to side walls with difference signals produced by electronic processing of the stereo signals supplied to the sidewall speakers. Such an arrangement can provide double dipole sidewall loudspeakers with nulls facing the audience and the walls in an auditorium setting. Such a configuration can be created by selecting one of the modes of operation of the sidewall loudspeakers as described in U.S. Pat. No. 5,301,237. In contrast, U.S. Pat. No. 4,819,269 discloses sidewall loudspeakers that broadcast over a 180° arc. The former of these disclosures teaches use of a five or seven channel surround sound processor whereas the latter teaches a two (stereo) channel sound source with additive or subtractive electric combinations of the two channels fed to the sidewall and rearwall loudspeakers.

The inventor of above U.S. Pat. No. 4,819,269 further develops his additive or subtractive approach to two channels fed to two loudspeakers in an article, Klayman, Arnold I., "Surround Sound With Only Two Speakers", *Audio,* August 1992, pp. 32–37.

U.S. Pat. No. 4,847,904 and U.S. Pat. No. 5,117,459 disclose pairs of dihedral loudspeakers and additive or subtractive approaches to combining the electric signals from the right and left channels within the loudspeakers. In the former patent the outwardly directed drivers subtractively combine both channels and the inwardly directed drivers use a single channel. In the latter patent the channels are electrically combined in a different manner.

U.S. Pat. No. 4,888,804 discloses loudspeakers having the full range drivers directed to the listening area, limited range boundary drivers 180° out of phase directed a specific 65° from the full range drivers and in-phase limited range expansion drivers outwardly directed from the listening area. According to the patent, boundary drivers provide a cancellation of first arrival room boundary reflections as well as late arrival reflections. To restore the late arrival reflections which give a perception of spaciousness the in-phase expansion drivers restore the late arrival reflections.

Of interest is the research disclosed in Kantor, K. L. and DeKoster, A. P., "A Psycho-acoustically Optimized Loudspeaker", *Journal of the Audio Engineering Society*, Vol. 34, No. 12, December 1986, pp. 990–996; wherein the optimal angles of the direct sound and the ambient sound maxima to the listener are 26° and 54°, 0° being defined as directly forward of the listener. Such an arrangement is said to cause minimum interaural cross-correlation.

Also of interest are recent articles on binaural recording and loudspeaker reproduction as well as transaural recording and reproduction in Griesinger, David, "Theory and Design of a Digital Audio Signal Processor for Home Use", *Journal*

*of the Audio Engineering Society,* Vol. 37, No. 1/2, January/February 1989, pp. 40–50; Griesinger, David, "Equalization and Spacial Equalization of Dummy-Head Recordings for Loudspeaker Reproduction", *Journal of the Audio Engineering Society,* Vol. 37, No. 1/2, January/February 1989, pp. 20–29; and Cooper, Duane H., and Bauck, Jerold L., "Prospects for Transaural Recording", *Journal of the Audio Engineering Society,* Vol. 37, No. 1/2, January/February 1989, pp. 3–19. The new loudspeaker surround sound technique disclosed below can be used to increase the robustness of the transaural techniques and significantly reduce the amount of signal processing required to achieve the desired acoustic effects.

SUMMARY OF THE INVENTION

Surprisingly in a home theater setting the effect of completely surrounding the listener with loudspeakers driven by separate channels can be accomplished with loudspeakers only placed forward of the listener. The invention comprises the generation of skewed hypercardioid sound energy fields (polar plots) from right front and left front "surround" loudspeakers. The skewed hypercardioid sound energy fields direct the principal nulls toward the expected listener location and the secondary nulls in a direction that "reflects" off the front wall of the home theater room back toward the expected listener location. The overwhelming majority of the skewed hypercardioid sound energy field is directed away from the expected listener location in a home theater setting and toward the side walls of the room. Since the differences between the front and rear sound field head related transfer functions are much smaller than the differences between the head related transfer functions of the frontal and lateral sounds, the majority of the sound effect produced by the new sound energy field is believed to arise from the lateral gradient component of the sound field. If, nevertheless, the loudspeakers are carefully set up in a room with favorable acoustics, the illusion of sound coming from behind the listener is common. This is believed to arise from the careful elimination of early sound arrival from the frontal direction in the surround channels.

Each surround loudspeaker contains an antiphase driver in addition to other drivers and circuitry including a delay network that powers the drivers to create the skewed hypercardioid sound energy field. An important feature of the skewed hypercardioid sound field according to the invention is the insensitivity of the principal null direction to frequency over a range of several octaves centered from 250 $H_z$ to 4 $kH_z$ and which can extend below 120 $H_z$.

The skewed hypercardioid sound field can be applied in miniature to settings such as computer monitors where the listener is very close to the screen. A steep gradient in sound energy from each loudspeaker occurs over the distance between the ears of the listener. In another setting at the other extreme the principal nulls can be directed at an expected microphone location in a large room or auditorium. Since the angle between the maximum energy and the minimum energy of the loudspeaker can be less than 90°, the feedback squeal can thereby be minimized or prevented with both the audience and the microphones located forward of the loudspeakers.

Thus, depending on the setting, the surround loudspeakers can be used with or without loudspeakers having maximum sound energy directed at the expected listener location. Moreover, the invention leads to a generalized method of providing direct and reflected sound energy in an enclosed listening space since several parameters are variable: low pass filter with delay, the angular position of each of the drivers and the loudspeaker cabinet structure, as well as the directivity of the individual drivers.

Thus, the skewing of the hypercardioid radiation pattern can be varied along with the angle between the maximum and the minimum energy to produce a loudspeaker in which the angle between the output maximum and the principal output minimum can be less than 90° while at the same time maintaining substantially flat frequency response in any direction. The approach creates a generalized solution to using multichannel sources to create specific sound energy patterns in an enclosed listening space.

The method is particularly useful in applications where a steep amplitude gradient versus angle in the sound field is desired with a flat amplitude versus frequency response at all angles. With the use of co-axial high frequency and low frequency drivers the polar pattern of the sound energy field is maintained as much as 20°–30° above and below a horizontal plane through the axes of the co-axial drivers. Moreover, the skewed hypercardioid sound energy field can be further developed in a three dimensional space by mounting the drivers in baffles forming a polyhedron.

Although disclosed below as applied to dihedral loudspeaker cabinetry, the skewed hypercardioid sound field can be generated in a loudspeaker wherein the drivers are all located in a single planar baffle or even an inverse dihedral baffle. In the description following, each baffle is comprised of a bass reflex cabinet with no internal dividers separating the drivers except as otherwise noted, however, the invention is not limited to the bass reflex form of baffle or cabinet. For example, the baffle may be in the form of a wall mounted, wall recessed or in-automobile dash cabinet. In such configurations the skewed hypercardioid sound field of the invention is inherently skewed by the "folding over" of the back of the field substantially along the plane of the wall resulting in substantially all sound energy being directed forward of the wall. The novel sound field is generated by suitable changes and adjustments to the electric circuitry, principally the delay networks, to adjust for the different physical geometry of the particular baffle. According to the invention additional cancelling drivers can be added to produce additional nulls or a widening of the principal nulls in the sound energy field. In the microphone setting and other settings noted above, the surround loudspeakers can be reversed right to left to direct maximum energy at the audience and the additional nulls at the front and side walls to minimize reflected sound.

The invention is also well suited for improving the sound field pattern of surround loudspeakers intended for positioning in a more conventional manner along the sidewalls, rear walls or ceiling of a listening room. By considering the positioning of the loudspeakers together with the direction of the major output axis and the axis of the principal nulls, it is possible to create a reflected "phantom loudspeaker" with its principal sound energy coming to the listener from the direction of the loudspeaker's reflection in a room boundary yet having accurate tonal balance emitted in all directions from the loudspeakers. Conversely, by aiming the major output axis toward the listener it is possible to eliminate one or more spurious reflected phantom loudspeakers. This is accomplished by directing the minima of the reflected phantom loudspeakers toward the listener.

DESCRIPTION OF THE PREFERRED EMBODIMENTS

Figure 1:
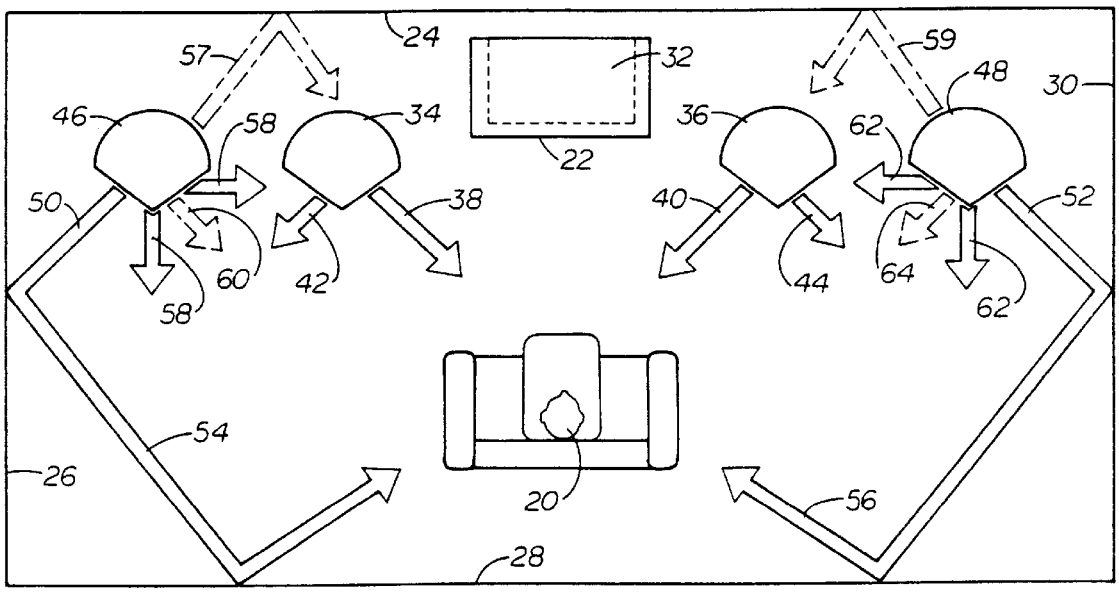
FIG. 1 illustrates in plan view a home theater arrangement of the loudspeakers in a room.

In FIG. 1 a home theater setting comprises a user 20 seated at some distance from a television screen 22 within a room having a front wall 24, left side wall 26, back wall 28 and right side wall 30. The television screen 22 may be a self-contained television set or movie screen with a ceiling mounted projector, for example.

A center channel loudspeaker 32 may be located above, below or behind the television screen 22. There also is typically a "subwoofer" which has considerable freedom of placement, especially if the other speakers are small. To either side of the screen 22 are left front (LF) 34 and right front (RF) 36 loudspeakers so placed and constructed as to direct maximum sound energy toward the user 20 as indicated by the larger arrows 38 (LF) and 40 (RF). Some sound energy (arrows 42 (LF) and 44 (RF)) is directed away from the listener by the "direct sound" loudspeakers, however, this sound energy provides desirable ambiance and correct left and right channel balance as a user 20 moves from the preferred listening location shown.

Further to either side are left surround (LS) 46 and right surround (RS) 48 loudspeakers so placed and constructed as to direct maximum sound energy toward the left side wall 26 and right side wall 30 as indicated by the arrows 50 (LS) and 52 (RS). Thus, maximum sound energy from the surround loudspeakers 46 and 48 is reflected off the sidewalls 26 and 30, respectively, and the backwall 28 before reaching the user 20 as indicated by extended arrows 54 and 56. The small solid and ghosted arrows 58 and 60 (LS) and 62 and 64 (RS) indicate that considerably less surround channel sound energy is directed generally toward the user. In particular, substantially null directions where the sound energy is minimized as much as possible are indicated by the ghosted arrows 60 (N) and 64 (N) for the surround loudspeakers 46 and 48. Secondary nulls are indicated by the ghosted arrows 57 and 59 reflected off the front wall 24.

Figure 2A:
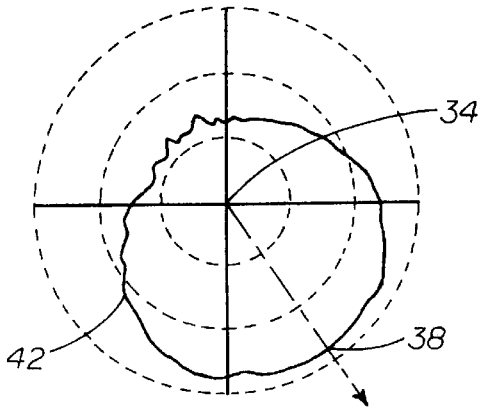
FIGS. 2*a,* 2*b,* 2*c* and 2*d* are polar plots of sound energy radiated by the individual loudspeakers in FIG. 1.
Figure 2B:
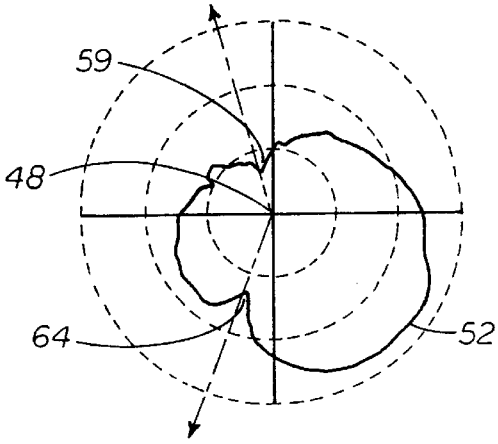
Figure 2C:
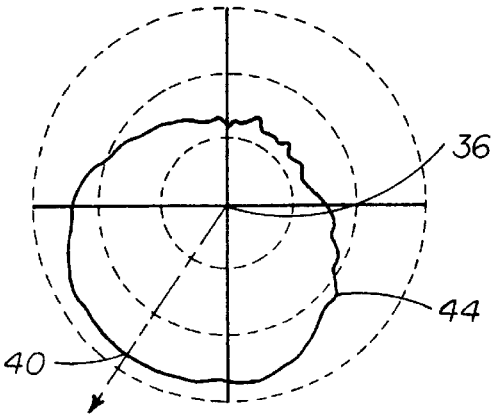
Figure 2D:
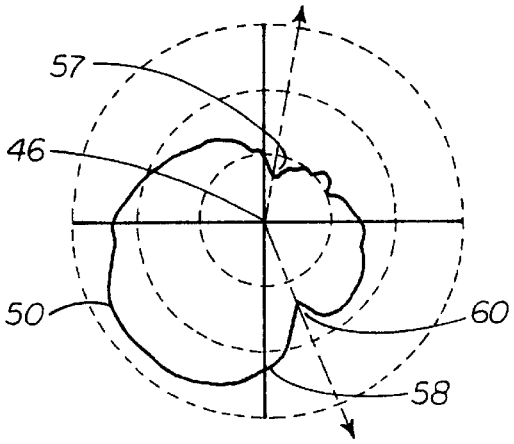

The series of small polar plots shown in FIGS. 2*a,* 2*b,* 2*c* and 2*d* illustrate the sound energy radiated by the four front and surround loudspeakers. The dashed rings indicate 10 db differences in sound energy. The left front 34 and right front 36 loudspeakers show the maximum sound energy or lobes 38 and 40 directed toward the user 20 with lesser energy 42 and 44 directed away from the user 20.

In contrast, the left surround 46 and right surround 48 loudspeakers show the maximum sound energy to be directed away from the user 20 by lobes 50 and 52 respectively, and distinctive principal nulls (N) 60 and 64 directed toward the user 20. The nulls are generally wide band as further described below rather than being specifically limited to certain frequency bands.

As is clearly evident the home theater arrangement is directed to make best use of four, five and six channel receiver-amplifiers now available for home theater sound systems. For example, the Dolby® Prologic™ four channel receiver-amplifier provides center, left front, right front and surround channels. And to greater advantage is the Dolby® AC-3™ five channel receiver-amplifier which provides center, left front, left surround, right front, and right surround channels. The AC-3 provides a sixth separate low frequency channel for subwoofers.

Figure 3:
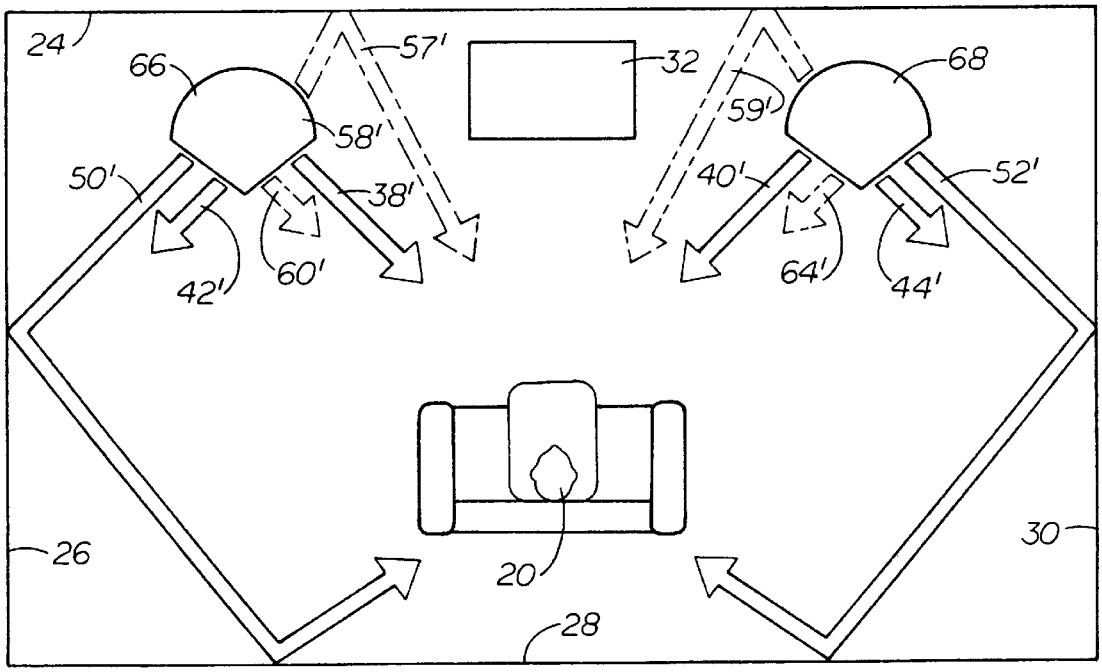
FIG. 3 illustrates in plan view a second home theater arrangement of the loudspeakers in a room.

Referring to FIG. 3 the left and right pairs of loudspeakers can each be combined into single left 66 (LF and LS) and single right 68 (RF and RS) loudspeakers to either side of the center loudspeaker 32 and user 20. Each loudspeaker 66 or 68 may employ the same number of drivers as each pair in FIG. 1, however, to reduce the physical size, weight and cost, dual voice coil drivers may be employed to reduce the number of drivers. Clearly, the use of dual voice coils is not required to practice this invention but rather is a cost saving approach. This invention does not depend upon the mixing and interaction of two input channels such as additions and subtractions in the electrical circuitry. Rather, in this invention the channels are electrically independent and the invention concerns the unique directional sound energy radiation patterns developed by each loudspeaker from the input channels fed thereto considered independently. Thus, the relative sound energy pattern from each single loudspeaker 66 or 68 resembles the corresponding pairs in FIG. 1 as best shown by the arrows in FIG. 3 with corresponding numbers primed.

Figure 4A:
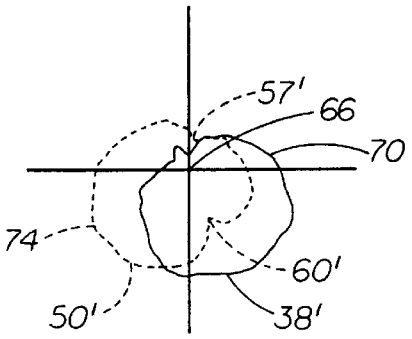
FIGS. 4*a* and 4*b* are polar plots of sound energy radiated by the individual loudspeakers in FIG. 3.
Figure 4B:
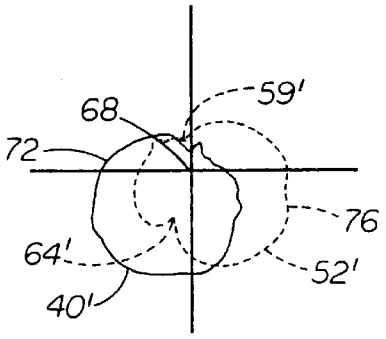

FIGS. 4*a* and 4*b* show small polar plots for the left 66 and right 68 loudspeakers respectively, with the left front 70 and right front 72 plots in solid line and the left surround and right surround plots 74 and 76 in dashed outline, respectively. Thus, the complete surround sound loudspeaker system can physically appear to be a two or three-speaker stereo system and does not displace more space or interfere more with other room decorating and furniture placement considerations than a stereo system in a home theater setting.

Figure 5:
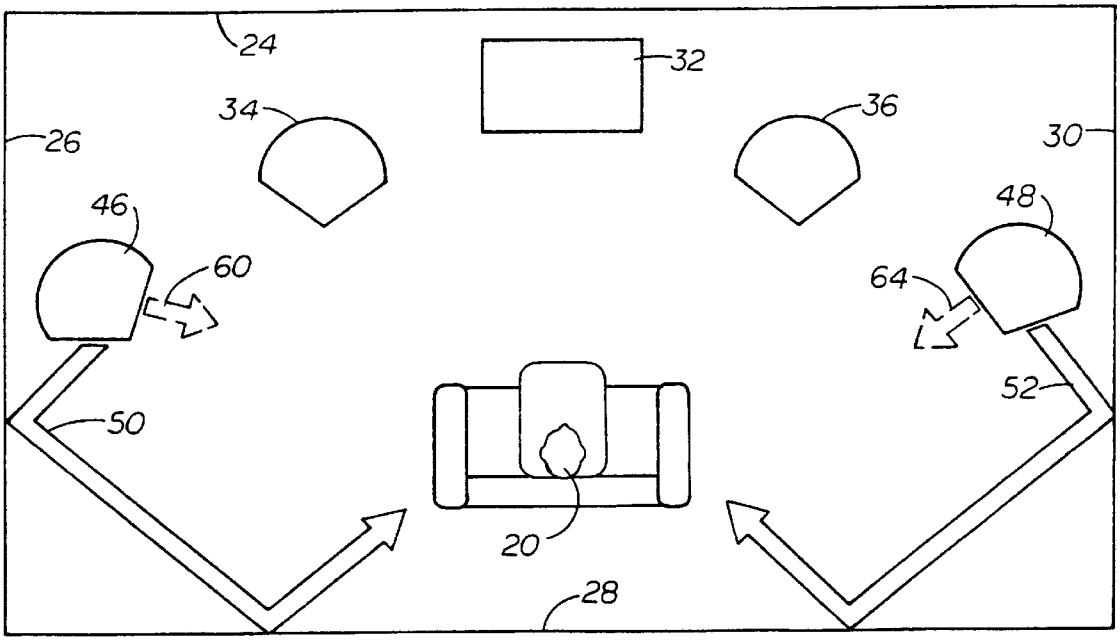
FIG. 5 illustrates in plan view a third home theater arrangement of the loudspeakers in a room.

FIG. 5 constitutes a modification of the four loudspeaker arrangement of FIG. 1. The room arrangement is generally as in FIG. 1, however, the left surround loudspeaker 46 (LS) and right surround loudspeaker 48 (RS) are placed adjacent the left sidewall 26 and right sidewall 30 as shown. Each surround loudspeaker is rotated to direct the nulls (N) 60 and 64 toward the user 20. With the rotation to properly direct the principal null each surround loudspeaker 46 or 48 can be positioned at substantially any location or height along its respective wall 26 or 30.

Figure 6A:
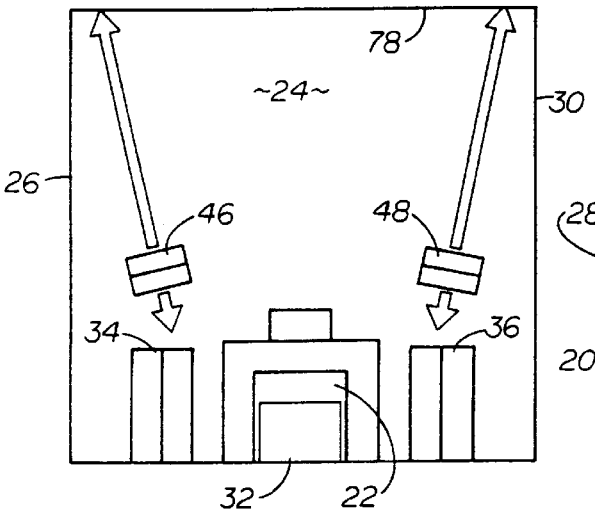
FIGS. 6*a* and 6*b* illustrate in side and front view, respectively, a fourth home theater arrangement of the loudspeakers that takes advantage of the ceiling of a room.
Figure 6B:
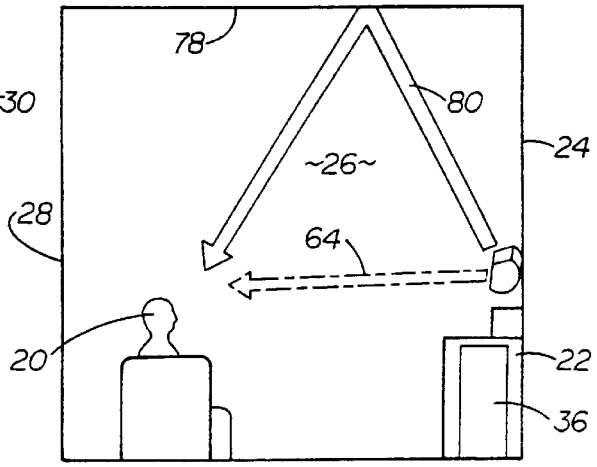

Similarly FIGS. 6*a* and 6*b* illustrate alternative positioning of the surround loudspeakers 46 (LS) and 48 (RS) vertically adjacent or on the front wall 24 of the home theater. In FIG. 6*a* as seen by the user the left surround loudspeaker 46 (LS) is positioned above the left front loudspeaker 34 (LF) and the right surround loudspeaker 48 (RS) is positioned above the right front loudspeaker 36 (RF). The surround loudspeakers 46 and 48 may be tilted to direct maximum sound energy toward the ceiling 78 or the upper left and right corners of the room. Depending on the tilt from horizontal to vertical an increasing amount of sound energy is directed toward the ceiling 78 as best shown in FIG. 6*b* by the arrow 80. As above, the surround loudspeakers 46 and 48 are rotated to position the principal nulls (N) 60 and 64 toward the user. In general, the surround loudspeakers are oriented to maximize the energy reflected from the sidewalls 26 and 30 and backwall 28 and to minimize the energy directed toward the expected listening area. In FIG. 6 as more energy is directed to the ceiling 78 and backwall 28, the sense of "depth" is emphasized relative to the sense of sound coming horizontally from the sides. Although this arrangement of loudspeakers may not be the most desirable for use with a Dolby multichannel sound processor, the arrangement adds an interesting new dimension which future multi-channel processors could use to advantage. For example, this arrangement could be used to direct the first reflection off the ceiling to simulate a speaker in the ceiling, for future multi-channel systems that call for a "height" channel, or a loudspeaker image reflected from any particular location desired. Thus, this particular arrangement has great applicability to a theater, concert hall or church.

Although loudspeakers with a non-skewed hypercardioid sound energy field might be positioned in substitution for the loudspeakers disclosed above, the angular relationships between the nulls and the maximum energy lobe prevent such loudspeakers from being positioned to provide the best combination of nulls directed and reflected toward the expected listening location and sound energy maxima reflected from the walls or ceiling.

Figure 7A:
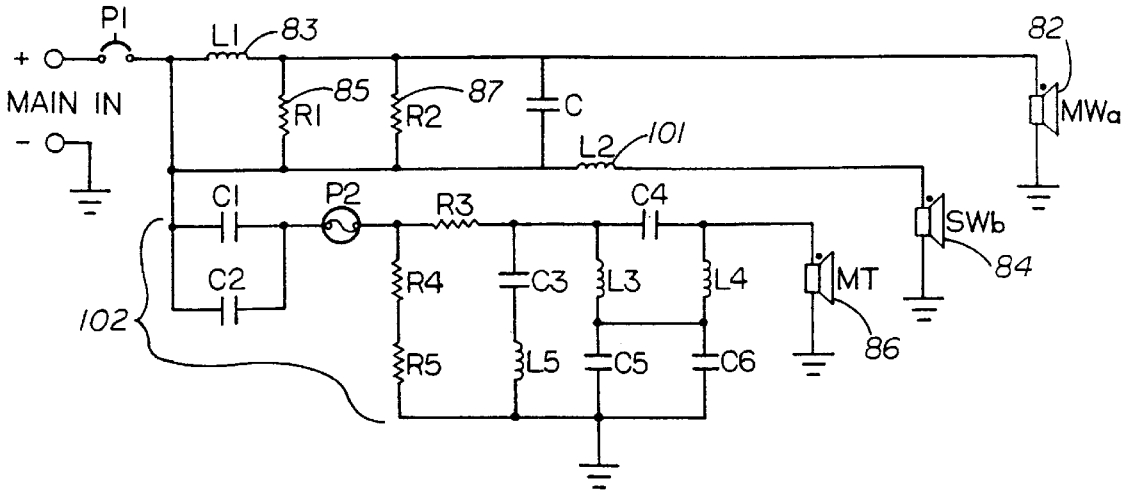
FIGS. 7*a* and 7*b* are schematics of the electrical circuits for either of the left or right loudspeakers in FIG. 3.
Figure 7B:
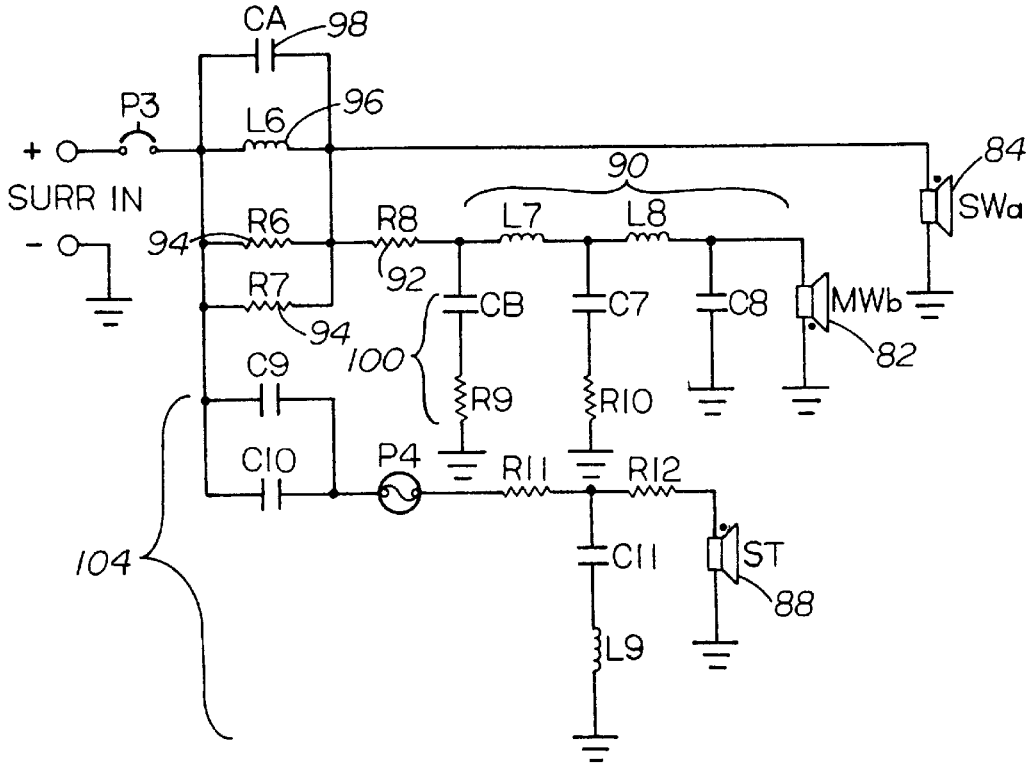

In FIGS. 7*a* and 7*b* the circuitry for each of the loudspeakers 66 and 68 in FIG. 3 is illustrated. The loudspeakers of this example have a 72° dihedral angle. The main circuit for sound directed at the user comprises FIG. 7*a* and the surround circuit comprises FIG. 7*b*. Within the loudspeaker are a pair of dual voice coil low frequency drivers 82 and 84 (MW and SW) (main woofer and surround woofer) centered about 7" apart and having 6" diameter diaphragms and a pair of high frequency drivers 86 and 88 (MT and ST) (main tweeter and surround tweeter). Drivers 82 and 86 (MW and MT) generally face the expected user 20 location and drivers 84 and 88 (SW and ST) generally face away from the user 20. The drivers of this example are co-axial, however, single voice coil and non-co-axial drivers may be substituted.

The first voice coil of low frequency driver 82 (MWa) is simply connected with direct polarity through an inductance 83 (L1) and two (2) resistances 85 (R1) and 87 (R2) to the main channel as shown in FIG. 7*a*. The second voice coil of low frequency driver 82 is connected through a delay network and low pass filter 90 through a resistor 92 (R8) in series therewith and a second resistance 94 (R6 and R7), inductance 96 (L6) and capacitance 98 (CA) in parallel to the surround channel as shown in FIG. 7*b*. Resistor 92 serves to considerably reduce the amplitude (energy) of the signal reaching the second voice coil. An optional capacitance and resistance shunt 100 may be connected (in parallel) to common after resistor 92 to further reduce higher frequency amplitudes to the second voice coil of low frequency driver 82. These may be simply incorporated into the network "low pass filter and delay." Furthermore, the polarity of the second voice coil of driver 82 is reversed. The parallel combination of resistance 94, inductance 96 and capacitance 98 are chosen to selectively attenuate a certain frequency, for the purpose of equalizing the particular amplitude response of the entire system as is described in my earlier patents on dihedral loudspeakers cited above. This equalizer equalizes the response of both the surround channel outwardly directed drivers and the antiphase inwardly directed driver thus producing the hypercardioid radiation patterns.

The surround low frequency driver 84 (SWa) has the first voice coil connected through the resistance 94, inductance 96 and capacitance 98 (equalizer) as shown in FIG. 7*b*. The second voice coil of surround low frequency driver 84 is connected through inductance 101 (L2) to the main channel to assist the low frequency energy output of the main channel driver.

The high frequency drivers 86 (MT) and 88 (ST) are driven through separate cross-over networks 102 and 104 as shown in FIGS. 7*a* and 7*b* respectively. However, the network 102 also serves to delay the signal to driver 86 relative to the signal to driver 82, controlling the radiation patterns of the combinations of 86 and 82.

The result of this combination of circuitry and drivers is to create an asymmetrical or skewed hypercardioid radiation pattern of energy in the surround channel, the null (N) being directed at the listener—user from the surround channel and a more conventional single-lobe radiation pattern in the "main" (left or right front) channel. Adjusting resistance 94, inductance 96 and capacitance 98 adjusts the balance frequency of the entire system while the asymmetrical hypercardioid pattern shape remains constant. An equivalent delay network and low pass filter could be constructed with active digital filtering in substitution for the analog passive network described. Also, all or part of the low pass filtering and delay may be incorporated as an acoustic filter and delay positioned between the cone of drivers 82 and the listening space.

It is possible to combine drivers 84 and 82 into one driver unit with the filter and delay comprising an acoustic filter supplied to the backside of driver 84 and vented to the atmosphere at the physical location of driver 82. While this purely physical configuration using only one driver diaphragm would sacrifice the flexibility of variable electrical delay and variable low pass filter parameters, it would be a viable alternative for maximum cost savings.

Figure 8:
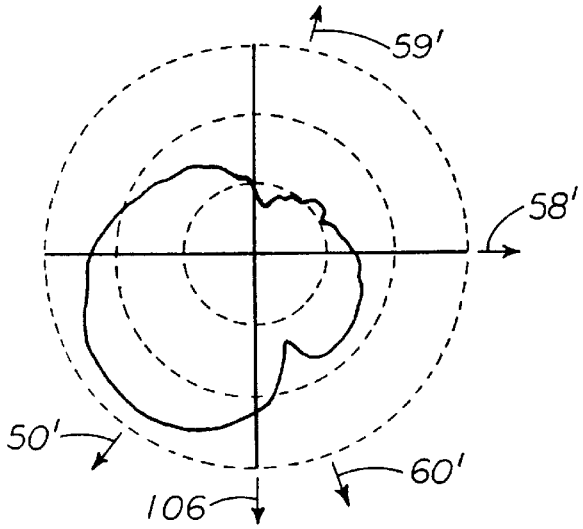
FIG. 8 is a polar plot of a left surround channel loudspeaker illustrating the overall energy pattern for home theater applications.

In the polar plot of FIG. 8 the preferred directions of the lobes for most home theater applications are detailed. The concentric rings indicate 10 db energy differential. Taking the direction of arrow 106 as the plane bisecting the dihedral angle between the front panels of a left loudspeaker in FIG. 3 (or left surround in FIG. 1), the maximum surround energy output 50' should be 30°–45° to the left. The side lobe direction 58' should be at least 6 db down and the forward direction 106 (0°) should be about 3 to 6 db down from maximum. The principal null 60' (N) is optimally about 15°–30° to the right of arrow 106. The null should be at least 12 db below the maximum energy, preferably 20 db down and effective over a 120 $H_z$ to 4 $kH_z$ bandwidth. The result from considerable development and testing is a sound experience comparable to or noticeably better than modern surround sound systems in commercial movie theaters, though the result is still highly dependent on listening room acoustics. The parameters specified above produce the most robust result, according to testing, while further improvement could be achieved by making the angle between the major lobe maximum 50' and null 60' adjustable for different room-wall-listening position situations as well as careful consideration of the design of the listening room itself.

As noted above in the Kantor reference, Kantor teaches that the loudspeakers should be set up in a listening room according to a 26° direct/54° ambient rule noted above. However, applicant has found that the surround illusion, particularly the ability to create the illusion of sound coming from the rear, is more robust if substantially the majority of the surround channel energy is directed more to the rear of the listening area, requiring an optimal launch angle of 30°–45°, rather than the 54° of Kantor. Nevertheless, the first reflected sidewall image may be set for 54° by judicious placement of the loudspeakers.

Important to creating the sound experience is the secondary null 59' directed from the back of the speaker so as to be "reflected" from the front wall toward the expected listener location as also indicated by ghosted arrows 59' in FIG. 3. As clearly shown by FIG. 8, the polar plot resembles a skewed hypercardioid with axes of the major lobe 50' and minor lobe 58' non-coincident and non-parallel. The skewed hypercardioid polar plot of overall energy shown in FIG. 8 for the left surround channel is created by the array of directional drivers and delay network in FIG. 7. The result is a sound field in a home theater environment that creates the ambience of sound from all directions without the need for rear or side wall loudspeakers.

Figure 9:
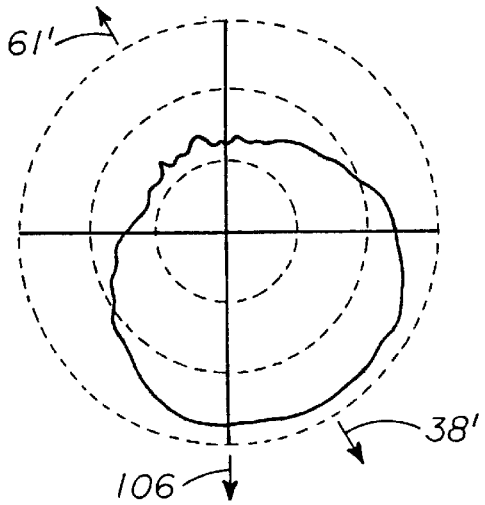
FIG. 9 is a polar plot of a left main channel loudspeaker illustrating the overall energy pattern for home theater applications.

In FIG. 9 for comparison purposes the left front channel polar plot shows a maximum amplitude 38' directed over a range of about 15°–45° generally toward the expected listener location with minimum energy 61' directed 180° from the maximum range. As shown with concentric rings of 10 db energy differential, the polar plot is on the same scale as FIG. 8.

Figure 10A:
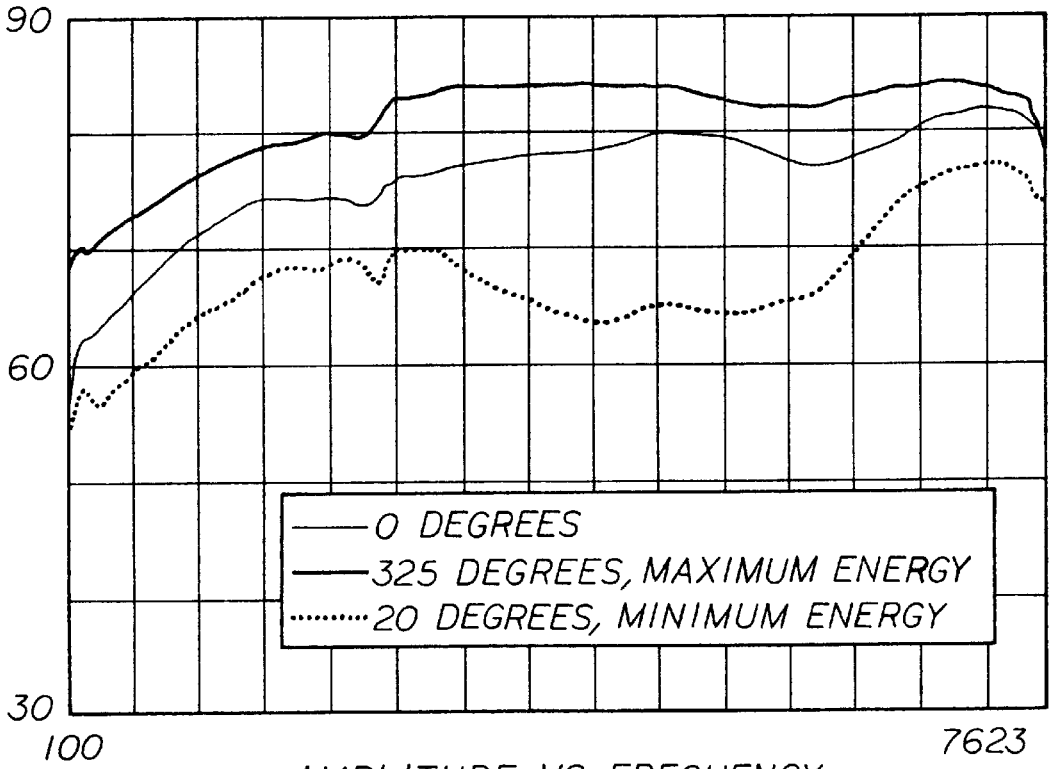
FIGS. 10*a* and 10*b* are plots of amplitude versus frequency for three polar directions of a loudspeaker showing the surround channel and main channel, respectively.

In FIG. 10*a* the substantial energy differences over the bandwidth as a function of angle from the dihedral plane 106 are clearly shown over the major portion of human hearing response for the surround channel. The null(N) direction, here labeled 20° is about 12 to 20 db below the maximum at 325° over virtually the entire 120 $H_z$ to 10 $kH_z$ range. Thus, the null in the surround channel is broadband and not limited to a narrow frequency band.

Figure 10B:
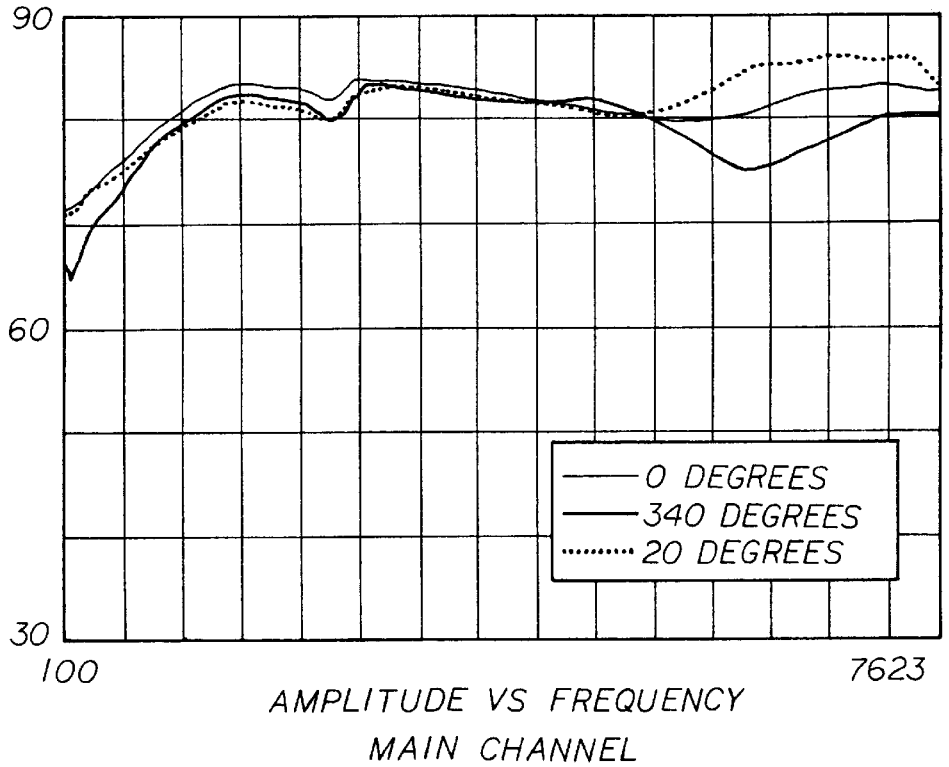

For comparison, FIG. 10*b* illustrates the front channel energy as a parametric function of angle from the dihedral plane. Here the energy remains within about +1 to −9 db relative to the maximum at about 20° over the 120 $H_z$ to 10 $kH_z$ range.

Figure 11A:
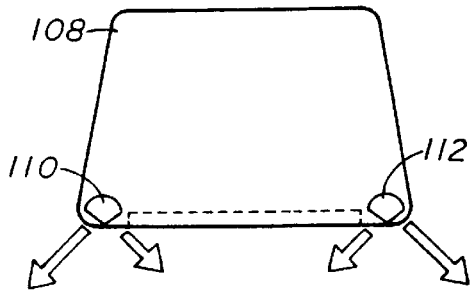
FIG. 11*a* illustrates a "mini-theater" arrangement adapted to a computer monitor.
Figure 11B:
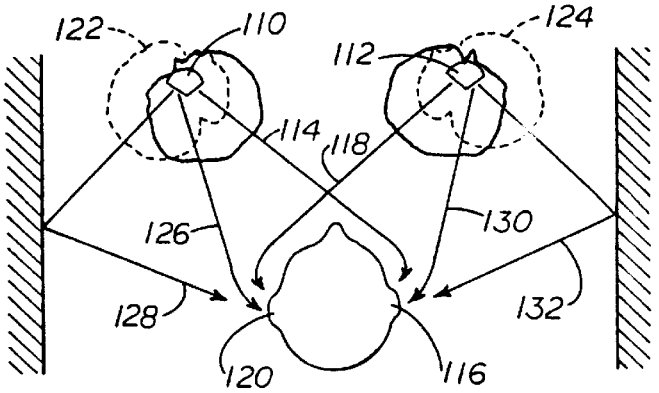
FIG. 11*b* illustrates the effect of the polar sound energy pattern of the "mini-theater" of FIG. 11*a;*

Illustrated in FIG. 11*a* is a computer monitor 108 having a pair of miniature loudspeakers 110 and 112 to either side of the monitor. The loudspeakers may be built into the monitor cabinet or placed to either side atop or alongside the monitor. As shown in FIG. 11*b,* each of the miniature loudspeakers 110 and 112 is a surround speaker so positioned that the null(N) 114 of the left speaker 110 is directed to the right ear 116 of the user and the null(N) 118 of the right speaker 112 is directed to the left ear 120.

Thus, with the dimensionally scaled down loudspeakers 110 and 112 in combination with the close proximity of the user, the nulls provide acoustic "cross-talk cancellation" for the furthest ears. The maximum energy becomes the surround lobes 122 and 124 of the respective speakers 110 and 112. This sound energy feeds directly to the nearest ear 120 from left speaker 110 as shown by arrow 126 and indirectly by arrow 128. In a similar manner, lobe 124 and arrows 130 and 132 show the direct and indirect sound energy to the right ear 116 respectively from speaker 112. Although all four direct and surround channels can be provided for the miniature loudspeakers, this is not necessary and only two channels need be provided. Thus, this configuration is well suited for use with conventional stereo broadcast to small portable radios and television sets as well as computer monitors. It is important to note that no electrical cross feeding, addition or subtraction of channels is required as distinguished from many previous systems wherein the loudspeakers are widely spaced in a normal room arrangement for stereo listening.

The difference in amplitude (energy) reaching each ear from each speaker is in essence a combination of the polar amplitude gradient of each channel's radiation pattern and the directionality of the reflected sound in the listening environment caused by the polar asymmetry of the radiation pattern. Either factor provides the surround sound acoustic effect, however, together the effect is enhanced.

The surround sound effect is also more pronounced in miniature (close range) speaker configurations because the energy gradient between the right and left ears is steeper with the skewed hypercardioid at close range. Thus, there is a strong lateral component of energy gradient and phase difference between the ears of the listener at close range to miniature speakers. The previous use of separated channels by cross-talk cancellation has often been in conjunction with other electric signal processing which renders the overall acoustic transfer function the equivalent of binaural reproduction of signals recorded with in-the-ear microphones or dummy head recordings. See for example: D. H. Cooper and Jerald L. Bauck, "Prospects for Transaural Recording", *J. Audio Eng. Soc.,* Vol. 37, No. 1/2, 1989 January/February, David Griesinger, "Equalization and Spatial Equalization of Dummy-Head Recordings for Loudspeaker Reproduction", *J. Audio Eng. Soc.,* Vol. 37, No. 1/2, 1989 January/February and David Griesinger, "Theory and Design of a Digital Audio Signal Processor for Home Use", *J. Audio Eng. Soc.* Vol. 37, No. 1/2, 1989 January/February. With the new skewed hypercardioid polar radiation pattern the robustness of the transaural effect is increased and the amount of electrical signal processing necessary to produce the required channel separation is reduced.

Figure 12A:
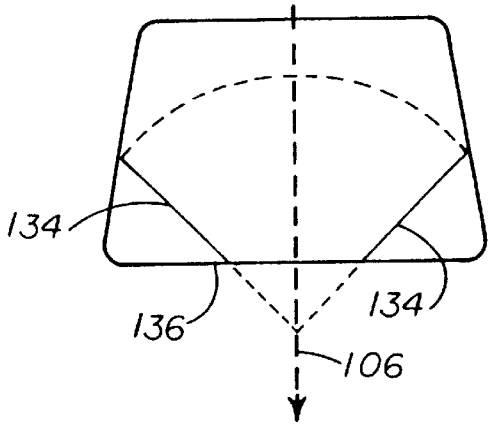
FIG. 12*a* illustrates a "mini-theater" arrangement with a single loudspeaker.
Figure 12B:
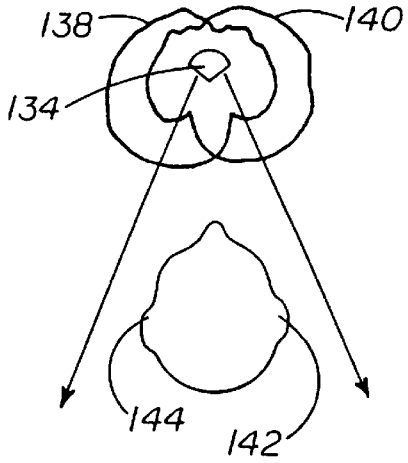
FIG. 12*b* illustrates the effect of the polar sound energy pattern of the "mini-theater" of FIG. 12*a;*
Figure 13:
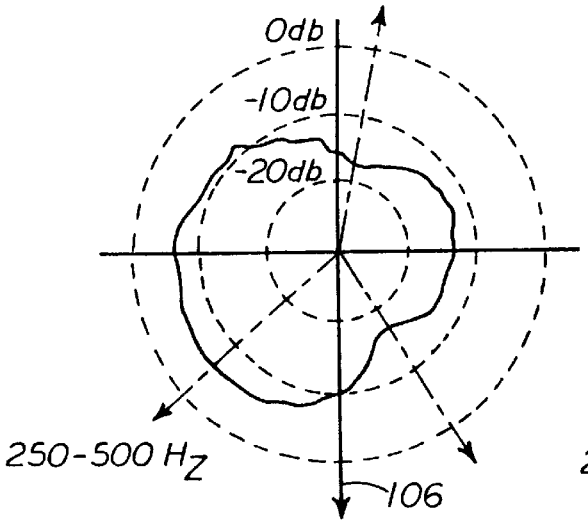
FIGS. 13 through 22 are polar plots of various multiple octave spans as indicated for a left surround channel loudspeaker (dihedral bisecting plane at 0°) illustrating the energy patterns over the particular multiple octave spans.
Figure 14:
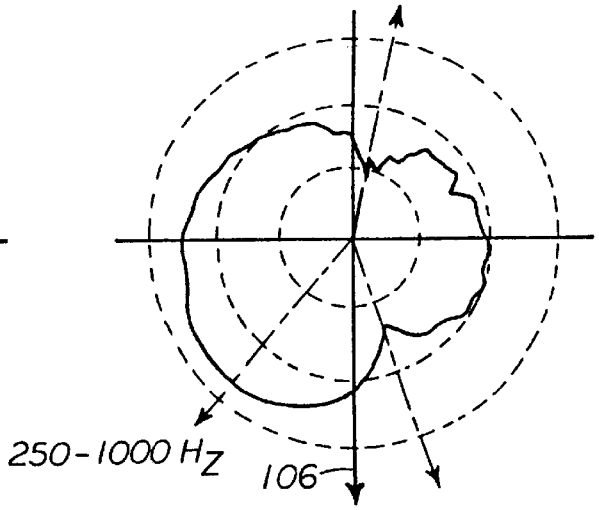
Figure 15:
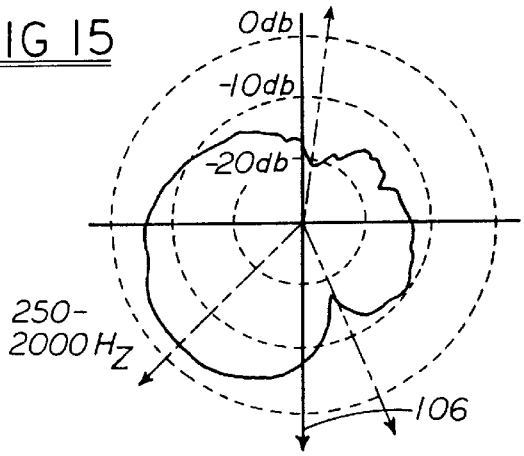
Figure 16:
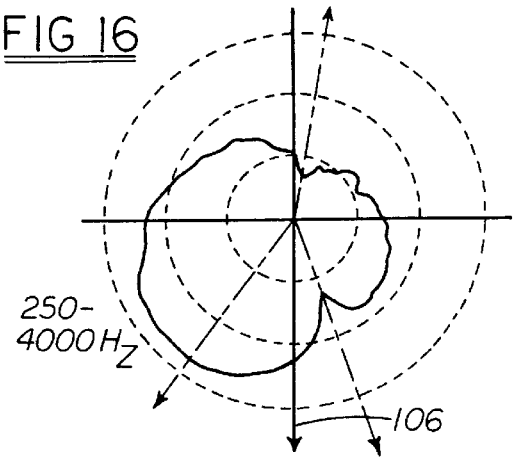
Figure 17:
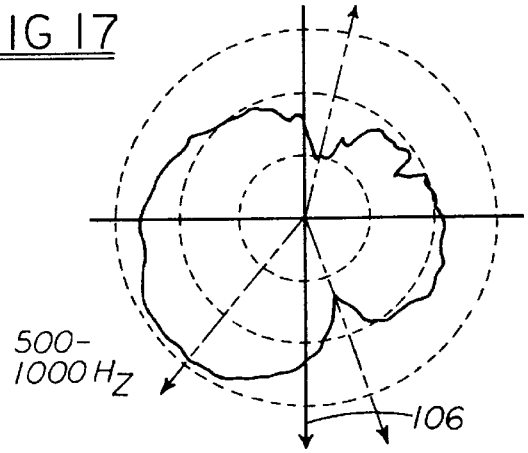
Figure 18:
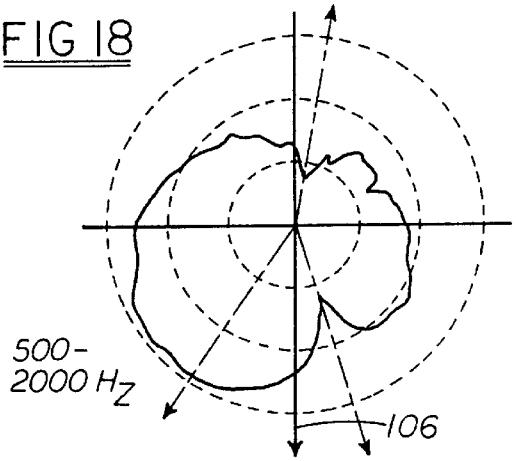
Figure 19:
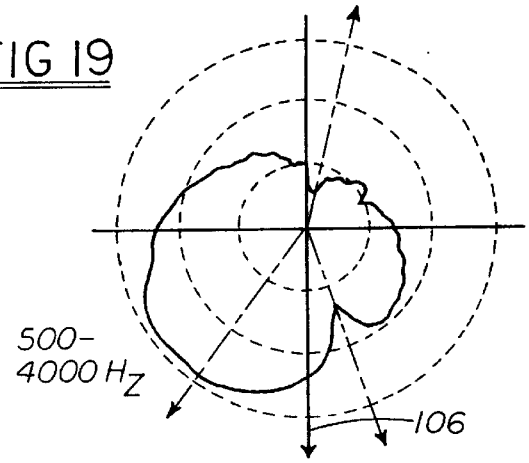
Figure 20:
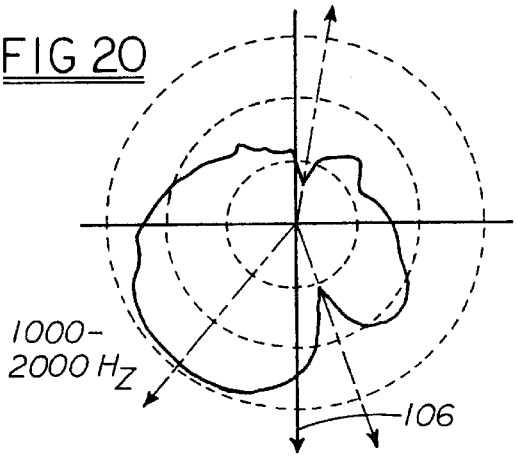
Figure 21:
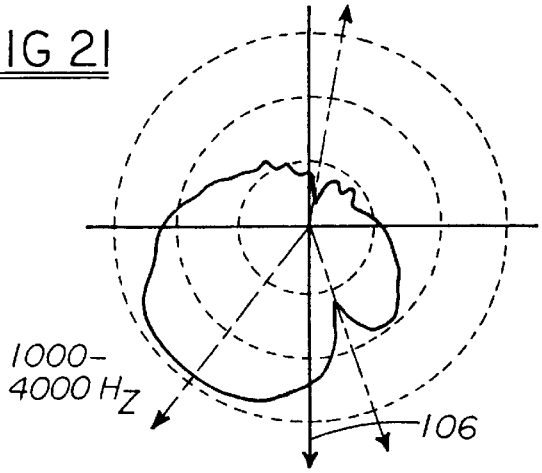

FIGS. 12*a* and 12*b* illustrate the further reduction to only one loudspeaker 134 atop, inside or below the monitor 136. The close proximity of the listener allows both channels to be superimposed acoustically from one dual-driver loudspeaker using dual voice coils as shown by the polar patterns 138 and 140 both having the nulls (N) directed to the furthest ears. In this case both channels in the cabinet would use the circuitry for the surround channel, as in FIG. 7*b,* along with the dual voice coil drivers and the tweeters. Thus, polar pattern 138 provides a null directed to the right ear 142 and maximum energy generally toward the left ear 144. Conversely, polar pattern 140 provides a null directed to the left ear 144 and maximum energy directed generally toward the right ear 142. In the embodiment shown in FIG. 12 a physical divider may be provided along the dihedral plane or separate cabinets divided along the dihedral plane. The addition of the physical divider along the dihedral plane will modify the polar sound field to some extent at lower frequencies and allow the loudspeaker to accept more power input.

The computer monitor examples of FIGS. 11 and 12 may clearly be applied to automobile sound systems, portable television and portable radios ("boom boxes").

Referring back to FIG. 7, the electric circuit provides for a null in response directed at a specific angle from the line 106 (dihedral plane) bisecting the angle between the axes of the two drivers. To retain this specific angle over a wide frequency band as illustrated in FIG. 9, the pair of drivers are not strictly wired in phase or out of phase but rather connected through the delay network which shifts the phase relationship as a function of frequency to retain the substantially fixed null angle (at which the drivers are co-acting out of phase).

In FIGS. 13 through 22 the series of polar plots of sound energy vividly illustrate the remarkable constancy of direction of the principal null at 20° from the dihedral regardless of the frequency band chosen. The concentric rings illustrate 10 db intervals of energy differential. The reference numbers to frequency in $H_z$ refer to center frequencies for lower and upper octave bands that bound the frequency range of the test result. Only the 250–500 $H_z$ band (176 $H_z$ to 707 $H_z$) shown in FIG. 13, being restricted to low frequencies, shows a drift to about 30°. Thus, the null directed at the expected listener location retains its directionality regardless of frequency.

Figure 22:
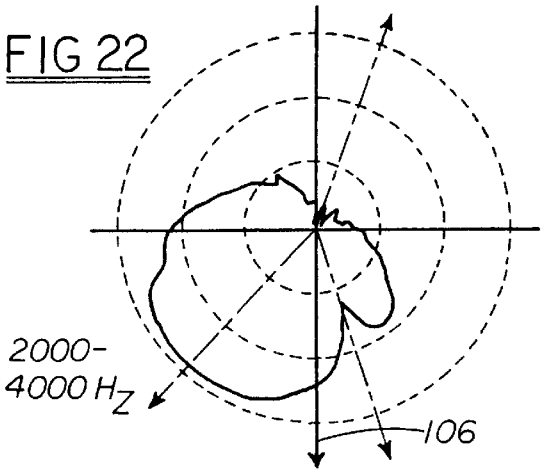

The secondary null emanating from the back of the loudspeaker remains between 150° and 180° from the dihedral, generally remaining between 165° and 180° until the highest frequencies are reached as indicated in FIG. 22 wherein the secondary null drifts toward 150°.

Referring back again to FIGS. 7*a* and 7*b,* the basic concept of the network is shown wherein the delay portion is configured to provide certain phase changes as a function of frequency. Selection of good drivers that have a smooth well-defined polar response of substantially constant directivity is important. As is well known to practitioners in the art, as the angle off the driver axis is increased, generally high frequency response falls off faster than low frequency response due to the ratio of radiating surface physical size to wavelength of radiated sound.

To compensate, loudspeaker driver 82 must be given an amplitude frequency response at angle 60' and angle 50' which is substantially the same as that of loudspeaker driver 84 at angle 60' and angle 50'. To clarify, to produce the principal null at angle 60' the response of driver 82 on or near its own axis must be made to match the response of driver 84 at an angle (60'+50') off its axis. Assuming drivers 82 and 84 have identical sensitivity and they both have directionality, less energy is needed for driver 82 to cause the null at 60'. If the radiating sources are on the order of three inches in diameter for the low frequency drivers and one inch in diameter for the high frequency driver, the compensation of loudspeaker driver 82 will be small and easy to implement using empirical testing techniques with a real time dual channel fast fourier transformation (FFT) analysis as described in my earlier U.S. Pat. No. 4,421,949. The empirical testing techniques are much easier to implement using full-range drivers or co-axial drivers described in my earlier patents and presently used in the loudspeaker products of DCM Corporation, in particular U.S. Pat. No. 4,578,809.

The delay network and low pass filter circuit is modelled using, for example, Electronics Workbench, from Interactive Image Technologies, Ltd. of Toronto, Canada. The amplitude and phase response are viewed using a BODE plotter tool on the computer. The model amplitude and phase response are compared with the empirical plots found above with the FFT analysis of the actual loudspeaker as shown by comparing the response curves measured both on axis and off axis at the specified angles for the major lobe of the surround channel and the principal null directed toward the expected listener location.

Figure 23:
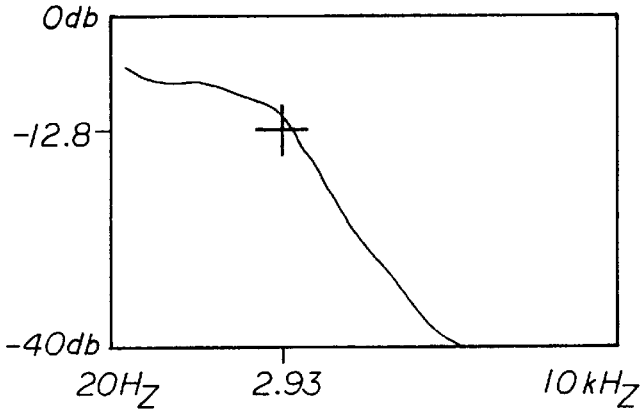
FIG. 23 illustrates an actual typical amplitude response BODE plot for a simplified computer model of the new loudspeaker.
Figure 24:
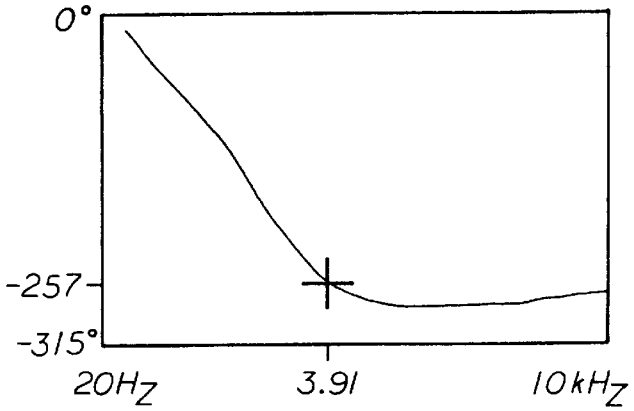
FIG. 24 illustrates an actual typical phase response BODE plot for a simplified computer model of the new loudspeaker.

FIGS. 23 and 24 illustrate BODE plots of amplitude and phase response for a modelled loudspeaker having 1 mH inductances and 5 ohm resistances in series to represent the drivers in the computer simulation. The BODE plot represents the transfer function between the voltages at the two speaker voice coils whose responses are to be matched at the angle of the principal null. Thus, the simulation represents the measurement of the voltage at the voice coil of the surround driver 84 and the voice coil of driver 82 that are to be matched. In FIG. 23 the amplitude scale is linear and the cursor (cross) is at −12.8 db and 2.93 $kH_z$. As shown the amplitude response is decreased gradually to about 3 $kH_z$ and then rolls off in a manner similar to the response of a single low frequency driver off-axis by an angle substantially the same as the angle between the major lobe and the principal null.

In FIG. 24 the phase scale is linear and the cursor (cross) is at −257° and 3.91 $kH_z$. The slope of the phase curve is proportional to the delay in the circuit and shows a substantially linear phase versus frequency change of almost −315° or slightly less than two reversals of polarity over the frequency band shown. The reversal of polarity at about 100 $H_z$ creates the null until the polarity reverses again by 4 $kH_z$.

Figure 25:
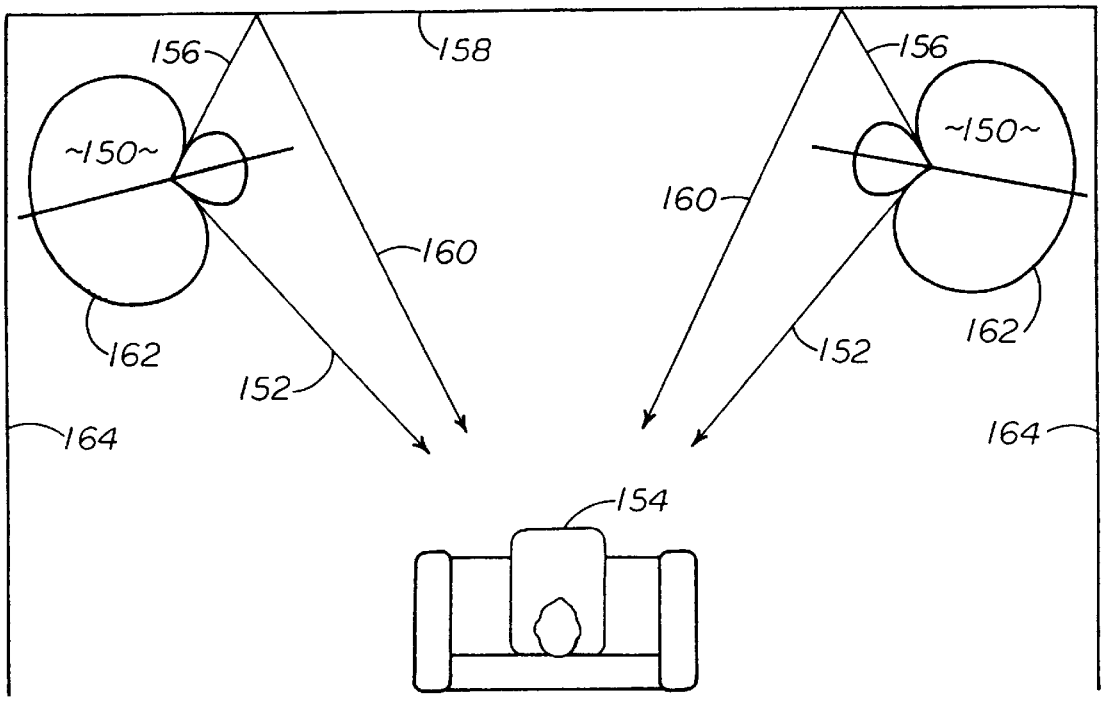
FIG. 25 illustrates in polar plot a hypercardioid surround sound energy field with one null directed at the expected listener location and the other null directed at the front wall for reflection toward the expected listener location.

FIG. 25 illustrates for comparison a symmetric hypercardioid polar sound energy field 150 from a loudspeaker positioned to direct one of the nulls 152 toward an expected listening location 154 and the other null 156 toward a front wall 158 to reflect toward the expected listening location as indicated by arrow 160. The major lobe 162 of sound energy is thereby directed at the sidewall 164 for further reflection, however, such a sound energy distribution is very inflexible in comparison to the skewed hypercardioid disclosed above. The hypercardioid does have some potential utility where the front wall, side walls and listener locations can be predicted in advance such as in an automobile or van. For example, the loudspeaker drivers can be located to either side of the automobile dashboard and the nulls angularly positioned by adjusting the delay as desired. The sound can thereby be centered and the sound energy level made substantially equal for the driver and all passengers in the automobile.

Figure 26:
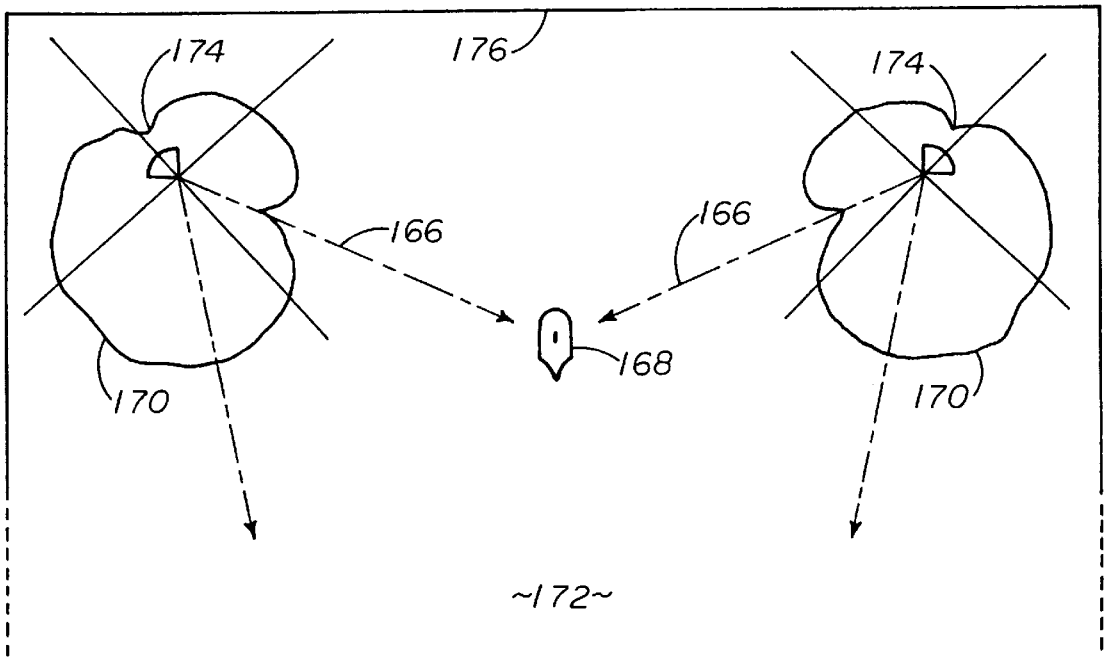
FIG. 26 illustrates the turning of the surround loudspeakers to direct maximum sound energy toward the audience and minimum sound energy toward the microphone and front wall.

In FIG. 26 the versatility of the skewed hypercardioid sound energy field is vividly demonstrated by its application to loudspeakers used in a room wherein the sound is generated, captured by microphone and amplified for an audience. With the skewed hypercardioid sound energy field the surround loudspeakers are merely redirected to direct the principal nulls 166 toward the microphone 168 and the major lobes 170 directly toward the audience 172. The other nulls 174 continue to be directed toward the front wall 176 more directly behind the loudspeakers. Thus, by directing the principal nulls 166 toward the microphone 168 feedback squeal or screech is suppressed as are sound reflections off the front and side walls of the room or auditorium.

Figure 27:
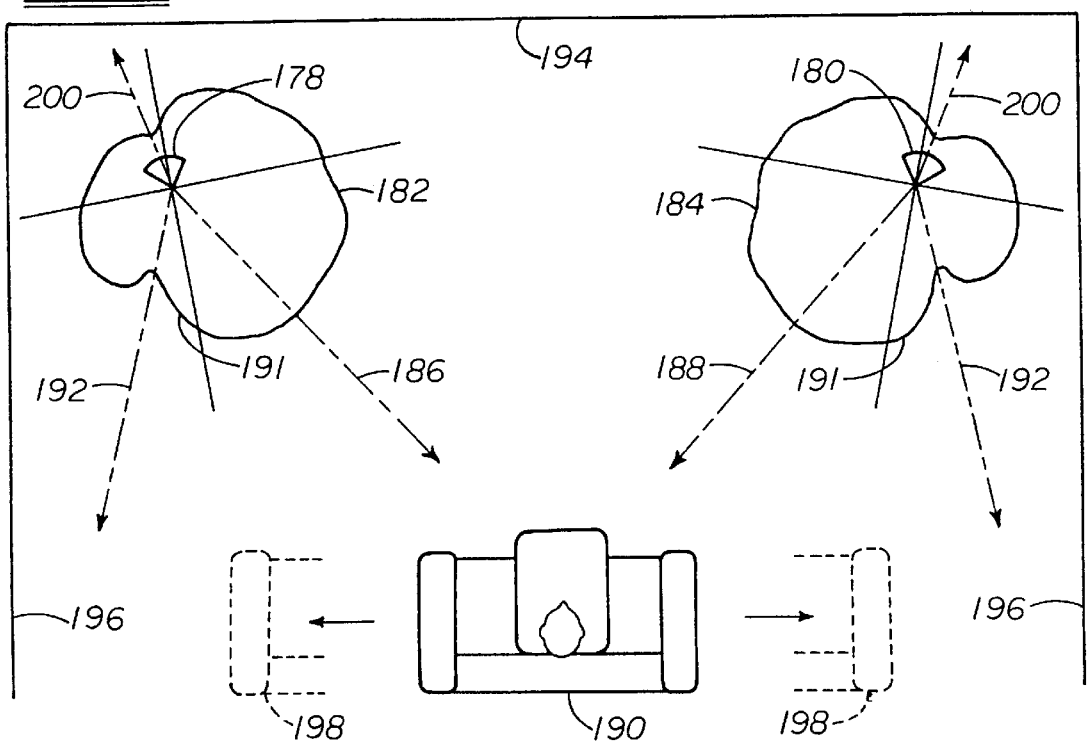
FIG. 27 illustrates the reversal of the surround loudspeakers to direct maximum sound energy toward the expected listener location and to maintain a centered sound image.

In FIG. 27 the surround loudspeakers 178 and 180 have been reversed right to left and left to right as indicated by the polar plots 182 and 184 with each loudspeaker oriented to direct the maximum energy 186 and 188 toward the expected listening location 190. As a result the minimum energy or principal nulls 192 are directed along side walls 196. More importantly the gradient 191 between the maximum 186 or 188 and the minimum 192 energy can be exploited to maintain the amplitude balance required to present a centered sound image for a listener sitting off center as indicated by 198. Thus, the principal nulls 192 are adjusted to shape the gradient 191 for a "phantom" center channel that remains centered as the listener moves off center in either direction 198. The nearer loudspeaker therefore balances the farther loudspeaker to maintain the center image.

Figure 28:
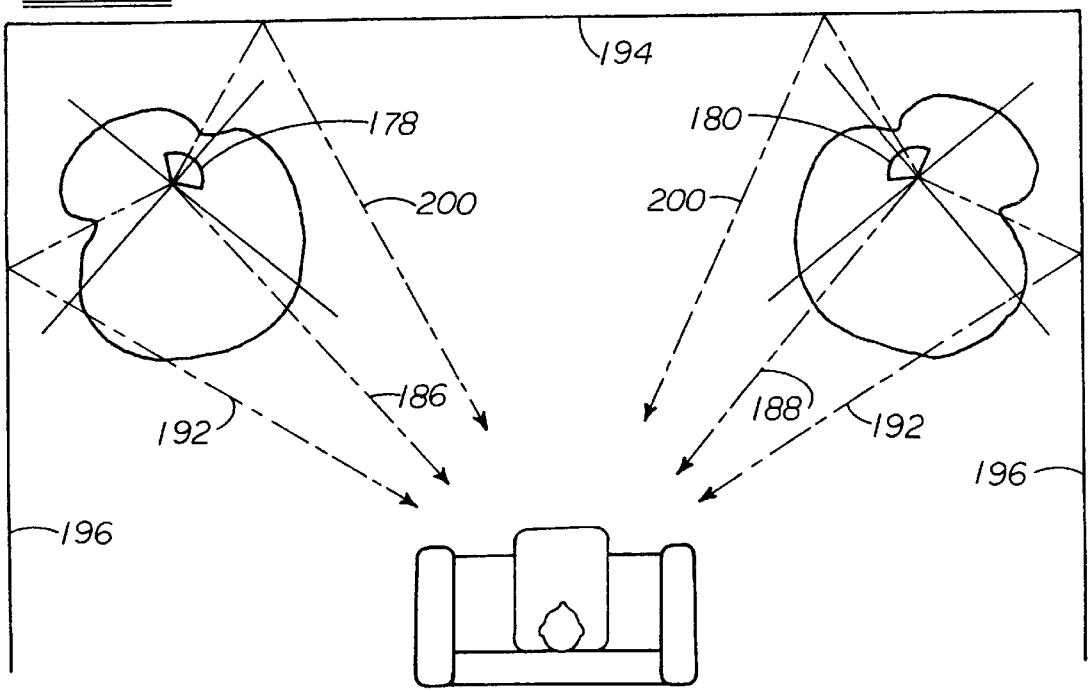
FIG. 28 illustrates the reversal of the surround loudspeakers to direct maximum sound energy toward the expected listener location and to direct minimum reflected energy from the front and side room walls.

In FIG. 28 the reversed loudspeakers of FIG. 27 are rotated to direct the reflected minima 192 and 200 at the expected listening location 190. Because the lobe of maximum sound energy is angularly broad, the maximum sound energy 186 and 188 remains generally directed at the expected listening location 190. Such an arrangement may be desired where room front 194 and side 196 wall acoustics are not suitable for reflected sound or in some outdoor settings where sound energy directed away from the expected listening location is never reflected and therefore wasted. Thus, the arrangement of FIG. 28 also simulates a live-end dead-end (LEDE) studio listening environment with minimal sound absorbing material required on the front wall or sidewalls. The positions of the loudspeakers 178 and 180 can be intermediate the positions in FIG. 27 and FIG. 28 as a compromise to obtain both effects from the loudspeaker system. Regardless, the octave to octave balance of each loudspeaker is maintained despite some change in gradient 191.

In actual practice the distance between the surround loudspeakers and the distance from the expected listening location and the loudspeakers can vary significantly depending on the room shape and individual desires. By adjusting the amount of delay, the principal null can be angularly swung relative to the loudspeaker to direct the principal null with precision for a particular room arrangement. Likewise in FIG. 26 movement of the microphone and podium can be accommodated electronically by swinging the principal nulls as an alternative to physically rotating the loudspeakers.

Where digital filters are used in the delay networks, such changes and other room characteristics can be accommodated by setting principal null directions with a computer program.

We claim:

1. The method of reproducing sound by creating spaced, multichannel acoustic energy sound fields generating at least two such sound fields, each comprising a substantially hypercardioid energy distribution wherein at least a first minimum of energy is located between a major lobe of energy and a minor lobe of energy, the first minimum of energy being directed toward an expected listener location and a second minimum of energy, the second minimum of energy being directed toward an expected near sound reflective surface to cause the reflected second minimum of energy to be directed toward the expected listener location.

2. The method of reproducing sound by creating an acoustic energy sound field comprising generating a skewed hypercardioid energy distribution wherein at least a first minimum of energy is located between a major lobe of energy and a minor lobe of energy, the axis of the minor lobe of energy being directed at an angle substantially less than 180° from the axis of the major lobe.

3. The method of claim 2 wherein the first minimum of energy is directed toward an expected listener location and a second minimum of energy is directed toward an expected near sound reflective surface to cause the reflected second minimum of energy to be directed toward the expected listener location.

4. The method of claim 3 wherein the first minimum of energy is directed at an angle of less than 120° to the axis of the major lobe of energy.

5. The method of claim 2 wherein the first minimum of energy is directed at a specified listener location.

6. The method of claim 2 wherein the axis of the major lobe is directed toward a first expected near sound reflective surface for reflection to an expected listening location.

7. The method of claim 2 wherein the axis of the major lobe is directed toward a first expected near sound reflective surface for reflection to and re-reflection from a second sound reflective surface to an expected listening location.

8. The method of claim 7 wherein a second minimum of energy is directed toward another expected near reflective surface to cause the second minimum of energy to be reflected toward the expected listening location.

9. The method of claim 2 wherein the direction of the major lobe axis and the direction of the first minimum of energy are substantially independent of frequency over at least one octave.

10. The method of claim 2 wherein the direction of the major lobe axis and the direction of the first minimum of energy are substantially independent of frequency over a five octave span.

11. A loudspeaker means generating an acoustic energy sound field comprising in polar plot a skewed hypercardioid energy distribution wherein at least a first minimum of energy is located between a major lobe of energy and a minor lobe of energy, the axis of the minor lobe of energy being directed at an angle substantially less than 180° from the axis of the major lobe.

12. The loudspeaker acoustic energy sound field of claim 11 wherein the first minimum of energy is directed at an angle of less than 120° to the axis of the major lobe of energy.

13. The loudspeaker acoustic energy sound field of claim 11 wherein the first minimum of energy is directed at an expected listener location.

14. The loudspeaker acoustic energy sound field of claim 13 wherein a second minimum of energy is directed toward an expected near reflective surface to be reflected toward the expected listening location.

15. The loudspeaker acoustic energy sound field of claim 13 wherein the major lobe axis is directed toward a first expected near sound reflective surface for reflection to and re-reflection from a second sound reflective surface to an expected listening location.

16. The loudspeaker acoustic energy sound field of claim 13 wherein the direction of the major lobe axis and the direction of the first minimum of energy are substantially independent of frequency over at least one octave.

17. The loudspeaker acoustic energy sound field of claim 13 wherein the direction of the major lobe axis and first minimum of energy are substantially independent of frequency over a five octave span.

18. The loudspeaker acoustic energy sound field of claim 11 wherein the skewed hypercardioid energy distribution extends substantially upwardly and downwardly from the plane of the skewed hypercardioid energy distribution.

19. A loudspeaker comprising at least one electroacoustic driver and at least one baffle containing the driver and electric circuit means in communication with the driver, the improvement comprising means to produce a sound energy field of substantially skewed hypercardioid form in polar plot having at least one first distinct minimum of energy generally directed toward an expected listener location and at least one major lobe of maximum energy directed away from the listener location.

20. The loudspeaker of claim 19 wherein a second minimum of energy is directed away from the listener location at an angle greater than 90° from the axis of the major lobe.

21. The loudspeaker of claim 19 wherein the directions of the two minima of energy are asymmetrically directed relative to the axis of the major lobe.

22. The loudspeaker of claim 19 wherein one minimum is directed at an angle of less than 120° from the axis of the major lobe.

23. A composite sound radiating system comprising at least a first component sound radiating system and a second component sound radiating system, each component sound radiating system having directivity defined by at least one single major lobe of acoustic output with an axis, the two axes being directed non-parallel, there being at least one minimum of acoustic output from the composite sound radiating system and at least one maximum of acoustic output from the composite sound radiating system, means in communication with each sound radiating system, said means creating a delay and polarity reversal in the acoustic output of the second sound radiating system relative to the first sound radiating system and creating a difference in amplitude versus frequency response of the acoustic output of the major lobe of the second sound radiating system relative to the first sound radiating system, whereby the amplitude of the acoustic output in the direction of maximum sound radiation from the second sound radiating system is less than the maximum amplitude of the acoustic output of the first sound radiating system and a minimum of acoustic output from the second component sound radiating system is directed substantially parallel to the major lobe axis of the first component sound radiating system.

24. The composite sound radiating system of claim 23 wherein the delay and polarity reversal means create a match in the substantially on axis amplitude versus frequency response of the second sound radiation system to the substantially off axis amplitude versus frequency response of the first sound radiating system.

25. The composite sound radiating system of claim 23 wherein the sound radiating system having the maximum acoustic output has the maximum acoustic output directed toward an expected listening location.

26. The composite sound radiating system of claim 25 wherein the directions of lesser maximum acoustic output and the minimum of acoustic output from the second component are less than 120° apart.

27. The composite sound radiating system of claim 26 wherein the sound radiating system has the maximum acoustic output directed toward the expected listening location and the at least one minimum of acoustic output directed away from the expected listening location.

28. A loudspeaker comprising at least a first sound radiating system and a second sound radiating system, each sound radiating system having at least one single major lobe of acoustic output with an axis, the two axes being directed non-parallel, at least one minimum of acoustic output from one of the sound radiating systems, electric circuit means in communication with each sound radiating system, said electric circuit means creating a delay in electric signal to one sound radiating system relative to the other sound radiating system and creating a difference in amplitude of the electric signal to one sound radiating system relative to the other sound radiating system, whereby the amplitude of the acoustic output in the direction of maximum sound radiation from one sound radiating system differs from the maximum amplitude of the acoustic output of the other sound radiating system and a minimum of acoustic output from one sound radiating system is directed substantially parallel to the one major lobe axis of the other sound radiating system.

29. The loudspeaker of claim 28 wherein the sound radiating system of lesser maximum acoustic output has the maximum acoustic output directed away from the expected listening location and a minimum of acoustic output directed toward the expected listening location.

30. The loudspeaker of claim 29 wherein the directions of lesser maximum acoustic output and minimum acoustic output are less than 120° apart.

31. The loudspeaker of claim 30 wherein the sound radiating system of greater maximum acoustic output is directed toward the expected listening location.

32. The loudspeaker of claim 28 wherein the sound radiating system of lesser maximum acoustic output has the maximum acoustic output directed toward the expected listening location and a minimum of acoustic output directed away from the expected listening location.

33. A loudspeaker comprising at least one electroacoustic driver and at least one baffle containing the driver and electric circuit means in communication with the driver, the improvement comprising means to produce a sound energy field of substantially skewed hypercardioid form in polar plot having at least one first distinct minimum of energy and at least one major lobe of maximum energy.

34. The loudspeaker of claim 33 wherein one baffle is located to the left side of an automobile and the other baffle is located to the right side of the automobile.

35. The loudspeaker of claim 34 wherein two first distinct minimums of energy are directed generally toward the sides of the automobile and two major lobes of energy are directed generally toward the occupants of the automobile.

36. The loudspeaker of claim 33 wherein at least one baffle is physically divided along a dihedral plane to form separate baffles each containing at least one electroacoustic driver.

37. The loudspeaker of claim 34 including a wall wherein in polar plot a back portion of the sound energy field is folded over by the wall.

* * * * *